US006334557B1

(12) United States Patent
Yang

(10) Patent No.: US 6,334,557 B1
(45) Date of Patent: Jan. 1, 2002

(54) CAPPED CONTAINER

(76) Inventor: Kuo-Chen Yang, 2 Fl., No. 2, Lane 21, Alley 34, Chung-Chiao St., Youngho City, Taipei Hsien (TW)

( * ) Notice: Subject to any disclaimer, the term of this patent is extended or adjusted under 35 U.S.C. 154(b) by 0 days.

(21) Appl. No.: 09/709,292

(22) Filed: Nov. 13, 2000

(51) Int. Cl.[7] ..... B65D 25/40

(52) U.S. Cl. ..... 222/567; 222/569; 222/562; 222/420

(58) Field of Search ..... 222/567, 569, 222/562, 420, 422, 566, 212, 546; 215/318, 355, 334; 220/789, 784, 256

(56) References Cited

U.S. PATENT DOCUMENTS 3,318,496 A * 5/1967 Ayotte et al. ..... 222/546
3,362,590 A * 1/1968 Martin ..... 220/800
3,543,973 A * 12/1970 Berins ..... 222/571
4,427,138 A * 1/1984 Heilein ..... 222/546

* cited by examiner

*Primary Examiner*—Kevin Shaver
*Assistant Examiner*—Stephanie L. Willatt
(74) *Attorney, Agent, or Firm*—Bacon & Thomas, PLLC

(57) ABSTRACT

A capped container is disclosed, which includes a container body, a nozzle, a cap, and retainer means provided between the inside wall of the cap and the shoulder or nozzle tip of the nozzle for enabling the nozzle to be press-fitted first into the cap and then fastened to the opening of the container body with the cap. When holding the cap to aim the nozzle at the opening of the container body, the punch of an automatic machine is pressed on the top of the cap to force the nozzle into engagement with the opening of the container body without causing damage to the nozzle.

6 Claims, 6 Drawing Sheets

CAPPED CONTAINER

BACKGROUND OF THE INVENTION

1. Field of the Invention

The present invention relates to a capped container and, more particularly, to a capped container having an inserted nozzle, for example, the capped container for containing eye drops, iodine, mercuro-chrome liquid, hydrogen peroxide, or contact lens cleaning solution, or the capped container for a particular spray powder.

2. Description of Related Art

A known capped container with inserted nozzle, for example, the eye drops bottle shown in FIG. 1, comprises a bottle body 81, an inserted nozzle 82, and a cap 83. After filling of eye drops, the punch 8 of the automatic machine shown in FIG. 2 is driven to force the nozzle 82 into the opening 811 of the bottle body 81, and then the cap 83 is threaded onto the bottle body 81. Because the nozzle 82 is a small object, it is difficult to pick up the nozzle 82 and to hold it in accurate alignment with the opening 811 of the bottle body 81. The positioning portion 821 of the nozzle 82 must be inserted into the opening 811 of the bottle body 81 to a certain depth, so that the nozzle 82 can be tightly secured to the bottle body 81, preventing a leakage of eye drops. When driving the punch 8 to force the nozzle 82 into the opening 811 of the bottle body 81, the nozzle 82 may be tilted or broken. Further, driving the punch 8 against the top of the nozzle 82 may damage the upper surface of the nozzle 82. In case the inserted nozzle 82 is damaged, it cannot be easily checked after closing of the cap 83 on the bottle body 81 by the automatic machine.

Therefore, it is desirable to provide a capped container to mitigate and/or obviate the aforementioned problems.

SUMMARY OF THE INVENTION

The object of the present invention is to provide a capped container, which prevents damage to the inserted nozzle or tilting the inserted nozzle during its assembly process.

To achieve the object, the capped container of the present invention includes a container body, an inserted nozzle, and a cap, and is characterized in that retainer means is provided between the inside wall of the cap and the shoulder or nozzle tip of the nozzle for enabling the nozzle to be press-fitted first into the cap, so that the nozzle can be mounted with the cap to the container body and then press-fitted into the opening of the container body. Because the nozzle is held in the cap, the cap can easily be picked up and held in position to aim the nozzle at the opening of the container body, and punching the cap against the container body to force the nozzle into the opening of the container body does not cause damage to the nozzle.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
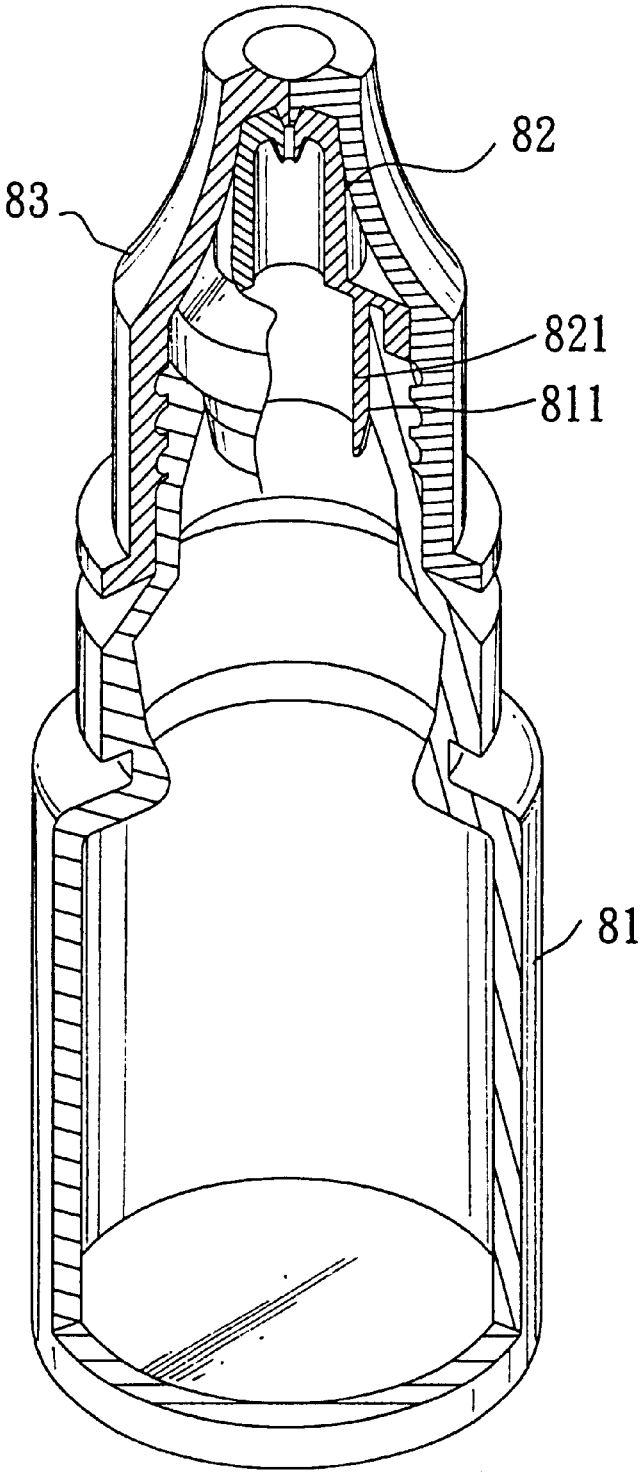
Fig. 1 (PRIOR ART)
FIG. 1 is a cutaway view of a capped container according to the prior art.
Figure 2:
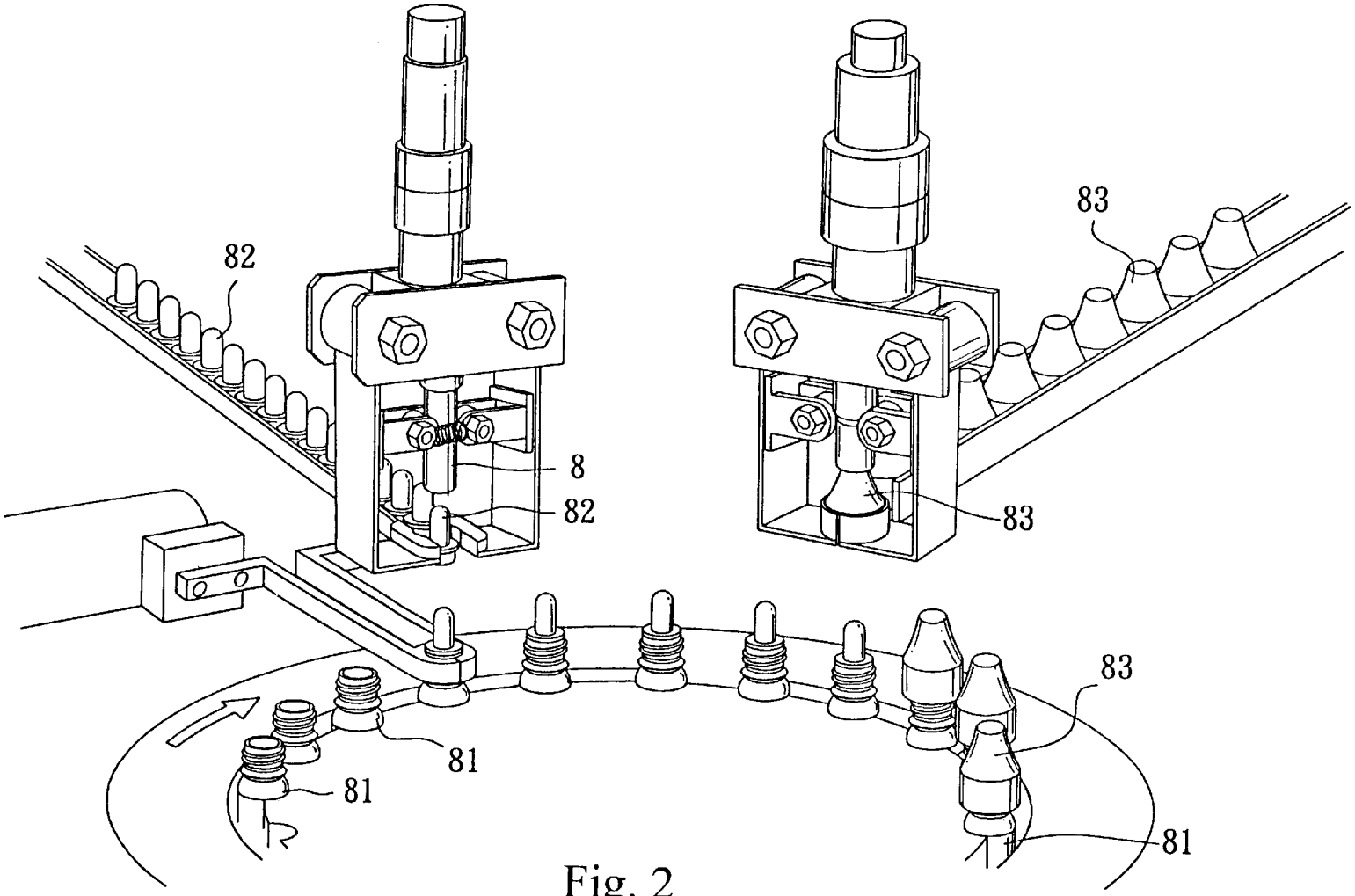
Fig. 2 (PRIOR ART)
FIG. 2 illustrates the assembly procedure of the capped container according to the prior art.
Figure 3:
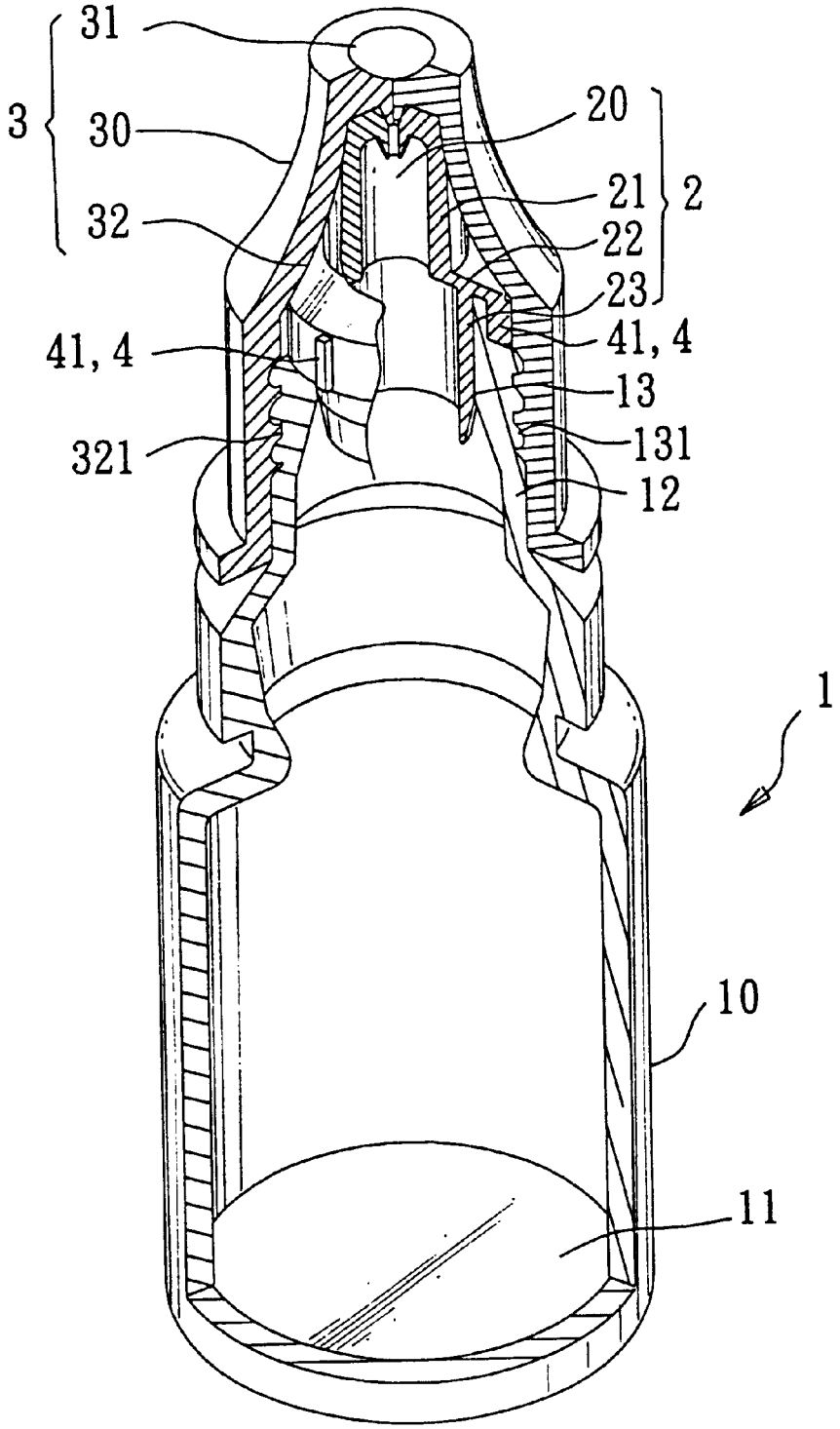
FIG. 3 is a cutaway view of a capped container according to the present invention.

With reference to FIG. 3, there is shown a capped container constructed according to the present invention. The capped container comprises a bottle 1. The bottle 1 comprises a bottle body 10 adapted to hold eye drops, a nozzle 2, a cap 3, and retainer means 4. The bottle body 10 comprises a closed bottom 11, an opening 13 in the top 12 thereof, and an outer thread 131 around the opening 13. The nozzle 2 is injection-molded from low-density polyethylene, comprising a nozzle tip 21, a shoulder 22, a mounting portion 23, and a nozzle hole 20 axially extended through the nozzle tip 21 for output of eye drops. The mounting portion 23 is used to press-fit into the opening 13 of the bottle body 10, keeping the shoulder 22 stopped above and sealing the opening 13. The cap 3 is injection-molded from high-density polyethylene, comprising a cap body 30 having a sealing top 31. The cap body 30 has an inner thread 321 disposed around the lower part of the inside wall 32 thereof and adapted for threading onto the outer thread 131 of the bottle body 10. After threading the inner thread 321 of the cap body 30 onto the outer thread 131 of the bottle body 10, the sealing top 31 of the cap body 30 seals the nozzle tip 21. The retainer means 4 of the present preferred embodiment comprises three retaining blocks 41 formed integral with and symmetrically spaced around the periphery of the shoulder 22 of the nozzle 2.

Figure 4:
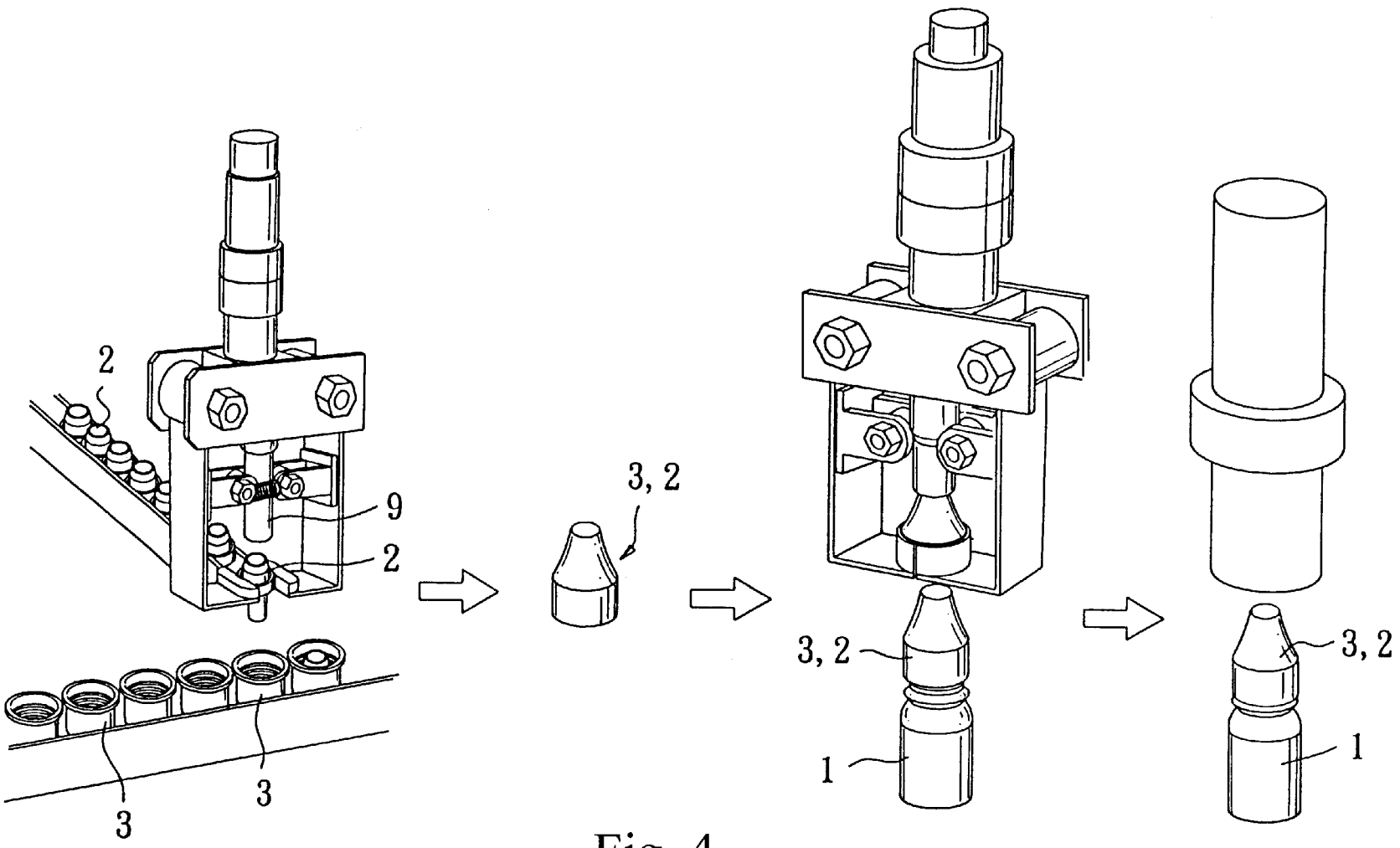
FIG. 4 illustrates the assembly procedure of the capped container according to the present invention.

The assembly process of the capped bottle 1 is outlined hereinafter with reference to FIG. 4. The punch 9 is operated to force the nozzle 2 into the invertedly disposed cap 3, causing the retaining blocks 41 of the shoulder 22 to be forced into engagement with the inside wall 32 of the cap 3. Because the nozzle 2 and the cap 3 are molded from materials of different hardness, the nozzle 2 can easily be press-fitted into the cap 3. Polypropylene, Acrylonitrile-butadiene-styrene, or other suitable plastic materials may be used instead of polyethylene for making the nozzle 2 with the retaining blocks 41, and the cap 3, enabling the nozzle 2 and the cap 3 to have different hardness. The nozzle 2 and the cap 3 can be made of same material if the precision is well controlled for enabling the nozzle 2 to be easily press-fitted into the inside wall 32 of the cap 3.

Referring to FIG. 4 again, after installation of the nozzle 2 in the cap 3, the cap 3 is turned back to the normal vertical position and aimed at the opening 13 of the bottle 1. Because the cap 3 is of much greater size than the nozzle 2, it can easily be picked up and held in accurate alignment with the opening 13 of the bottle 1. When pressing down the assembly of nozzle 2 and cap 3, the nozzle 2 is press-fitted into the opening 13 of the top 12 of bottle body 10 and cap 3 is installed onto bottle body 10. Because downward squeezing force is directly applied to the top of the cap 3, it does not damage the nozzle 21.

Figure 5:
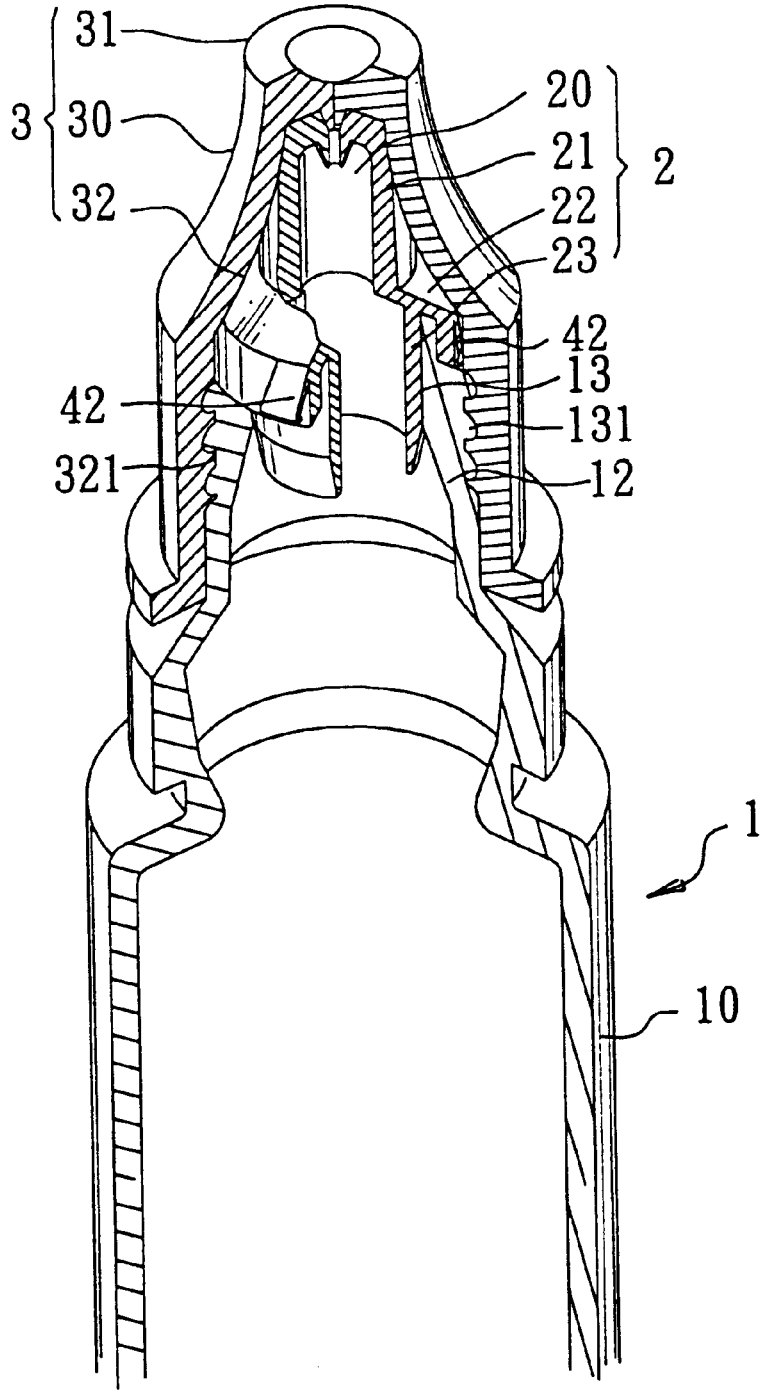
FIG. 5 is a cutaway view of an alternate form of the capped container according to the present invention.

FIG. 5 shows an alternate form of the capped container according to the present invention. According to this alternate form, the aforesaid retaining means comprises three springy retaining blocks 42 formed integral with and symmetrically spaced around the periphery of the shoulder 22 of the nozzle 2. Because the retaining blocks 42 are springy, the nozzle 2 can easily be press-fitted into the inside wall 32 of the cap 3.

Figure 6:
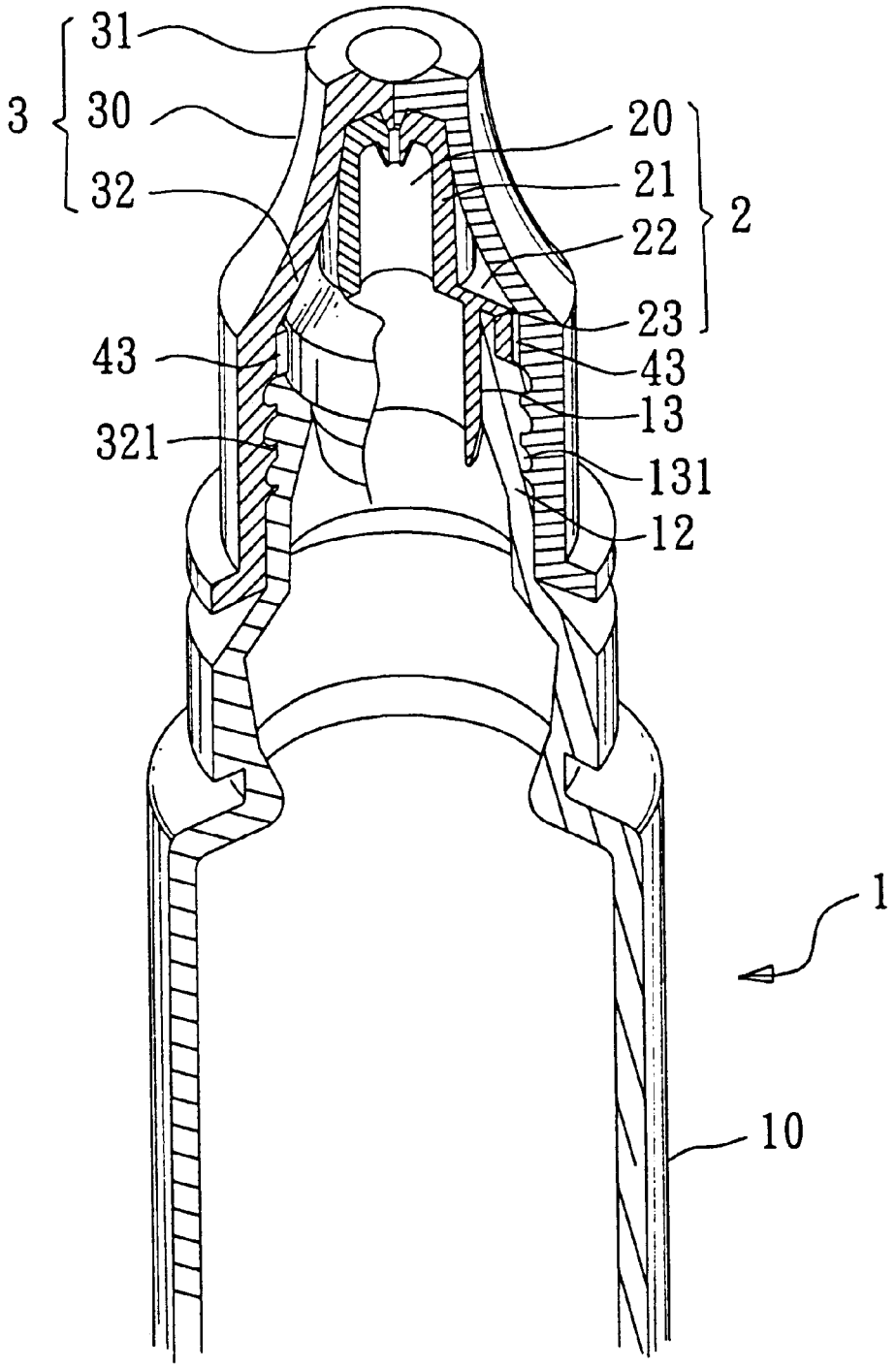
FIG. 6 is a cutaway view of another alternate form of the capped container according to the present invention.

FIG. 6 shows another alternate form of the capped container according to the present invention. According to this alternate form, the aforesaid retaining means comprises three retaining blocks 43 formed integral with and symmetrically spaced around the inside wall 32 of the cap 3 and adapted to hold down the nozzle 2 in the cap 3.

The aforesaid retaining blocks 41, 42 or 43 are formed integral with the periphery of the shoulder 22 of the nozzle 2, and can be formed integral with the inside wall 32 of the cap 3 alternatively. The retaining blocks also can be formed integral with the outside wall of the nozzle tip 21 of the nozzle 2, or the inside wall 32 of the cap 3 corresponding to the nozzle tip 21 of the nozzle 2. In still another alternate form of the present invention, the retaining means is made comprising an annular retaining flange formed integral with and around the inside wall 32 of the cap 3 for holding down the shoulder 22 or nozzle tip 21 of the nozzle 2.

Although the present invention has been explained in relation to its preferred embodiment, it is to be understood that many other possible modifications and variations can be made without departing from the spirit and scope of the invention as hereinafter claimed.

What is claimed is:

1. A capped container comprising:

a container body, said container body having a closed bottom, a top, an opening passing through said top, and an outer thread disposed around said opening;

a nozzle fastened to said container body, said nozzle comprising a mounting portion press-fitted into the opening of said container body, a shoulder stopped above and sealing the opening of said container body, and a nozzle tip extended out of the opening of said container body, said nozzle tip defining a nozzle hole; and a cap fastened to said container body and enclosing said nozzle, said cap comprising a cap body, said cap body having a sealing top adapted to seal the nozzle hole of said nozzle tip of said nozzle, an inside wall, and an inner thread formed on said inside wall for threading onto the outer thread of said container body, wherein a retainer means is provided at the periphery of the shoulder of said nozzle for enabling the mounting portion of said nozzle to be first press-fitted into the inside wall of said cap before installation of said cap onto said container body, so that said nozzle can be fastened together with said cap as an assembly to the opening of said container body.

2. The capped container as claimed in claim 1, wherein said retainer means comprises at least two retaining blocks.

3. The capped container as claimed in claim 2, wherein said at least two retaining blocks are arranged in symmetry.

4. The capped container as claimed in claim 1, wherein said retainer means comprises springy means.

5. The capped container as claimed in claim 1, wherein said nozzle and said cap are respectively made of materials of different hardness.

6. The capped container as claimed in claim 5, wherein said nozzle is made of low-density polyethylene, and said cap is made of high-density polyethylene.

* * * * *